US007064731B2

(12) United States Patent
Doyen et al.

(10) Patent No.: US 7,064,731 B2
(45) Date of Patent: Jun. 20, 2006

(54) DISPLAY DEVICE COMPRISING LUMINOPHORS

(75) Inventors: Didier Doyen, La Bouexière (FR); Herbert Hoelzemann, Merkelbach (DE); Jonathan Kervec, Gévezé (FR)

(73) Assignee: Thomson Licensing, Boulogne-Billancourt (FR)

( * ) Notice: Subject to any disclaimer, the term of this patent is extended or adjusted under 35 U.S.C. 154(b) by 417 days.

(21) Appl. No.: 10/362,482

(22) PCT Filed: Aug. 16, 2001

(86) PCT No.: PCT/FR01/02617

§ 371 (c)(1),
(2), (4) Date: Feb. 25, 2003

(87) PCT Pub. No.: WO02/17288

PCT Pub. Date: Feb. 28, 2002

(65) Prior Publication Data

US 2004/0008161 A1 Jan. 15, 2004

(30) Foreign Application Priority Data

Aug. 25, 2000 (FR) ..... 00 10922

(51) Int. Cl.
*G09G 3/28* (2006.01)

(52) U.S. Cl. ..... 345/60

(58) Field of Classification Search ..... 345/60–63, 345/204, 72, 88, 73; 313/486, 487, 581–587
See application file for complete search history.

(56) References Cited

U.S. PATENT DOCUMENTS 6,377,232 B1 * 4/2002 Chevet et al. ..... 345/63

FOREIGN PATENT DOCUMENTS

| | | |
|---|---|---|
| EP | 0896317 A2 | 2/1999 |
| EP | 0924684 A1 | 6/1999 |
| EP | 0974953 A1 | 1/2000 |

OTHER PUBLICATIONS

Search Report *.

* cited by examiner

*Primary Examiner*—Vijay Shankar
*Assistant Examiner*—Steven Holton
(74) *Attorney, Agent, or Firm*—Joseph J. Laks; Harvey D. Fried; Sammy S. Henig

(57) ABSTRACT

The invention corrects display faults due to the disparities between the phosphors of a display device. The correction is carried out by image processing. The invention provides a method for displaying a sequence of video images on a phosphor device comprising at least two types of phosphors together with the device comprising the means for implementing this method. The correction is carried out by computing an intermediate image between two successive images, then by displaying one of the two successive images on one type of phosphor and by simultaneously displaying the intermediate image on another type of phosphor.

10 Claims, 4 Drawing Sheets

PRIOR ART

DISPLAY DEVICE COMPRISING LUMINOPHORS

This application claims the benefit under 35 U.S.C. § 365 of International Application PCT/FR01/02617, filed Aug. 16, 2001, which claims the benefit of French Application No. 0010922, filed Aug. 25, 2000.

BACKGROUND OF THE INVENTION

1. Field of the Invention

The invention relates to a display device using phosphors to display the dots of an image. The invention is more particularly applicable to plasma display panels and to cathode-ray tubes using high scanning frequencies.

2. Description of the Prior Art

Plasma display panels (PDP) and cathode-ray tubes (CRT) comprise, on their front face, a layer made of a luminescent material which converts either UV radiation or electron radiation into visible light radiation. The luminescent material is commonly called a phosphor.

For monochromatic screens, the same phosphor is used over the entire front face of the CRT or PDP. On the other hand, for colour screens, three types of phosphor having different colours are generally used in order to synthesize colour. For specific applications, it is possible to have screens using two or more than three types of phosphor.

The use of phosphors having different colours exhibits some operational disparities due to the intrinsic characteristics of the materials forming the phosphors. Among the operational disparities, the temporal response to excitation is specific to each type of phosphor.

For CRTs, this fault is not generally perceived on low-definition screens, for example of TV type. However, it is possible to perceive slight faults in very-high-definition screens (for example 1600×1200 pixels) using high refresh frequencies (for example >120 Hz).

For PDPs, the disparities are very large. FIG. 1 shows phosphor reaction time diagrams commonly used in PDPs. FIG. 1A shows an excitation time period during which electrical discharges are sent into the panel in order to produce UV radiation (not shown). The UV radiation is then converted into visible light by the phosphors. FIG. 1B shows the light rendition for a blue phosphor, for example a barium magnesium aluminate doped with divalent europium. FIG. 1C shows the light rendition for a red phosphor, for example an yttrium borate doped with trivalent europium. FIG. 1D shows the light rendition for a green phosphor, for example a barium aluminate doped with manganese.

FIGS. 1B to 1D have different vertical scales which make the maximum values of each of the curves correspond. In reality, the maximum blue value is about 4.3 times greater than the maximum red value and about 5.5 times greater than the maximum green value. However, the light energy efficiency is substantially the same for each of the colours. These time diagrams make it possible to display the energy distribution per colour. By way of example, for a given excitation, the time durations for which the emitted light becomes less than 10% of the maximum emission value is indicated. Thus, less than one millisecond after the end of excitation, the blue colour is virtually extinguished while the red and green colours are still close to their maximum level, extinction of the red and of the green corresponding respectively to 11 and 13 ms.

FIG. 1E shows, on the one hand, the light renditions of the three colours with the same light intensity scale and on the other hand the sum of the three light renditions which corresponds to a pixel seen by the human eye. If the colour corresponding to the sum of the three renditions is looked at, it is noticed that the pixel is initially blue, then passes from blue to white (or grey depending on the intensity), then passes from white to yellow (combination of green and red of substantially the same intensity), and finally passes from yellow to green before being extinguished. In PDPs, the discharges repeat cyclically at the screen refresh frequency.

In the case of a stationary image, the persistence of vision of the human eye carries out filtering of low-pass type on the colour variations which masks this defect.

On the other hand, with a moving image, the eye becomes more sensitive to the colour variation at the colour transitions, which are displaced. Thus, a white object moving on a black background for example takes on a blue leading edge and a yellow trailing edge (green is not perceptible by the human eye in our example).

To overcome this type of problem, the only known solutions are to find novel phosphors in order to be able to use three types of phosphor having similar properties.

SUMMARY OF THE INVENTION

The invention aims to correct this display fault by image processing. In order to decrease the colour afterglow effects, the image display is delayed or advanced depending on the red, green or blue colour in question.

Thus, the invention is a method for displaying a sequence of video images on a phosphor device comprising at least two types of phosphors. In the method at least one intermediate image between two successive images is computed, then one of the two successive images is displayed on at least one type of phosphor and the intermediate image is displayed simultaneously on at least one other type of phosphor To optimize the improvement obtained, the intermediate image is computed with movement compensation.

Preferably, the two successive images are a current image and a previous image, and the intermediate image corresponds to an image delayed from the current image by a defined time period as a function of the types of phosphor.

To optimize the correction rendition, the defined time period is computed by taking the difference between the instants corresponding to the mean centres of gravity of light emission of the at least two types of phosphor.

The invention is also a device for displaying a video sequence comprising at least two types of phosphor, the said device comprising means for computing at least one intermediate image placed between two successive images and means for displaying the intermediate image on one of the types of phosphor and one of the successive images on the other type of phosphor.

DESCRIPTION OF THE DRAWINGS

The invention will be better understood, and other particular features and advantages will become apparent on reading the following description, the description refering to the appended drawings among which.

DETAILED DESCRIPTION OF PREFERRED EMBODIMENTS

After having noted the disparities between the types of phosphor, it is appropriate first of all to study the conceivable solutions. It is apparent that in order to reduce the fault as much as possible, it is preferable to offset the light emission for the three types of phosphor. Unfortunately, other hardware constraints do not allow disassociation of the switching on corresponding to each type of phosphor. For a CRT, the three electron beams corresponding to each of the colours are simultaneously controlled. With regard to PDPs, the cells are addressed row by row and each row has three types of phosphor.

According to the invention, the information to be displayed is offset. As was seen previously, the blue phosphors have a much shorter persistence time than the red or green phosphors, and the red phosphors have a shorter persistence time than the green phosphors. Intermediate images will therefore be displayed instead of a current image, denoted image I in FIG. 2, on the blue and on the red. Thus while displaying the image I, the visual information displayed corresponds to the image I for green and to two intermediate images for blue and red.

The intermediate image can be computed using various techniques. A person skilled in the art can refer to the publications relating to the image computations used to make a 50/60 Hz or 50/100 Hz image frequency change.

Preferably, it is desired that the intermediate image be as close as possible to the image which would have to be displayed at that instant, The invention relates to a display device using phosphors to display the dots of an image. The invention is more particularly applicable to plasma display panels and to cathode-ray tubes using high scanning frequencies.

Plasma display panels (PDP) and cathode-ray tubes (CRT) comprise, on their front face, a layer made of a luminescent material which converts either UV radiation or electron radiation into visible light radiation. The luminescent material is commonly called a phosphor.

For monochromatic screens, the same phosphor is used over the entire front face of the CRT or PDP. On the other hand, for colour screens, three types of phosphor having different colours are generally used in order to synthesize colour. For specific applications, it is possible to have screens using two or more than three types of phosphor.

The use of phosphors having different colours exhibits some operational disparities due to the intrinsic characteristics of the materials forming the phosphors. Among the operational disparities, the temporal response to excitation is specific to each type of phosphor.

For CRTs, this fault is not generally perceived on low-definition screens, for example of TV type. However, it is possible to perceive slight faults in very-high-definition screens (for example 1600×1200 pixels) using high refresh frequencies (for example >120 Hz).

Figure 1:
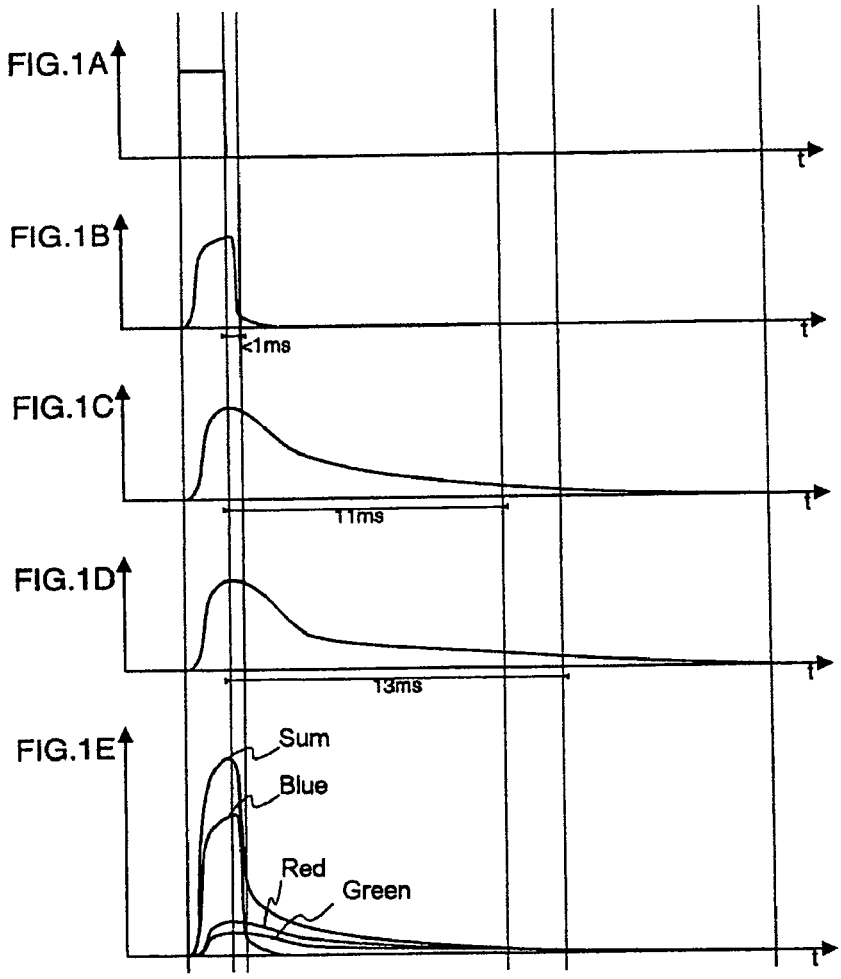
FIG. 1 shows phosphor response time diagrams.

For PDPs, the disparities are very large. FIG. 1 shows phosphor reaction time diagrams commonly used in PDPs. FIG. 1A shows an excitation time period during which electrical discharges are sent into the panel in order to produce UV radiation (not shown). The UV radiation is then converted into visible light by the phosphors. FIG. 1B shows the light rendition for a blue phosphor, for example a barium magnesium aluminate doped with divalent europium. FIG. 1C shows the light rendition for a red phosphor, for example an yttrium borate doped with trivalent europium. FIG. 1D shows the light rendition for a green phosphor, for example a barium aluminate doped with manganese.

FIGS. 1B to 1D have different vertical scales which make the maximum values of each of the curves correspond. In reality, the maximum blue value is about 4.3 times greater than the maximum red value and about 5.5 times greater than the maximum green value. However, the light energy efficiency is substantially the same for each of the colours. These time diagrams make It possible to display the energy distribution per colour. By way of example, for a given excitation, the time durations for which the emitted light becomes less than 10% the maximum emission value is indicated. Thus, less than one millisecond after the end of excitation, the blue colour is virtually extinguished while the red and green colours are still close to their maximum level, extinction of the red and of the green corresponding respectively to 11 and 13 ms.

FIG. 1E shows, one hand, the light renditions of the three colours with the same light intensity scale and on the other hand the sum of the three light renditions which corresponds to a pixel seen by the human eye. If the colour corresponding to the sum of the three renditions is looked at, it is noticed that the pixel is initially blue, then passes from blue to white (or grey depending on the intensity), then passes from white to yellow (combination of green and red of substantially the same intensity), and finally passes from yellow to green before being extinguished. In PDPs, the discharges repeat cyclically at the screen refresh frequency.

In the case of a stationary image, the persistence of vision of the human eye carries out filtering of low-pass type on the colour variations which masks this defect.

On the other hand, with a moving image, the eye becomes more sensitive to the colour variation at the colour transitions, which are displaced. Thus, a white object moving on a black background for example takes on a blue leading edge and a yellow trailing edge (green is not perceptible by the human eye in our example).

To overcome this type of problem, the only known solutions are to find novel phosphors in order to be able to use three types of phosphor having similar properties.

The invention aims to correct this display fault by image processing. In order to decrease the colour afterglow effects, the image display is delayed or advanced depending on the red, green or blue colour in question.

Thus, the invention is a method for displaying a sequence of video images on a phosphor device comprising at least two types of phosphors. In the method at least one intermediate image between two successive images is computed, then one of the two successive images is displayed on at least one type of phosphor and the intermediate image is displayed simultaneously on at least one other type of phosphor To optimize the improvement obtained, the intermediate image is computed with movement compensation.

Preferably, the two successive Images are a Current image and a previous image, and the intermediate image corresponds to an image delayed from the current image by a defined time period as a function of the types of phosphor.

To optimize the correction rendition, the defined time period is computed by taking the difference between the instants corresponding to the mean centres of gravity of light emission of the at least two types of phosphor.

The invention is also a device for displaying a video sequence comprising at least two types of phosphor, the said device comprising means for computing at least one intermediate image placed between two successive images and means for displaying the intermediate image on one of the types of phosphor and one of the successive images on the other type of phosphor.

Figure 2:
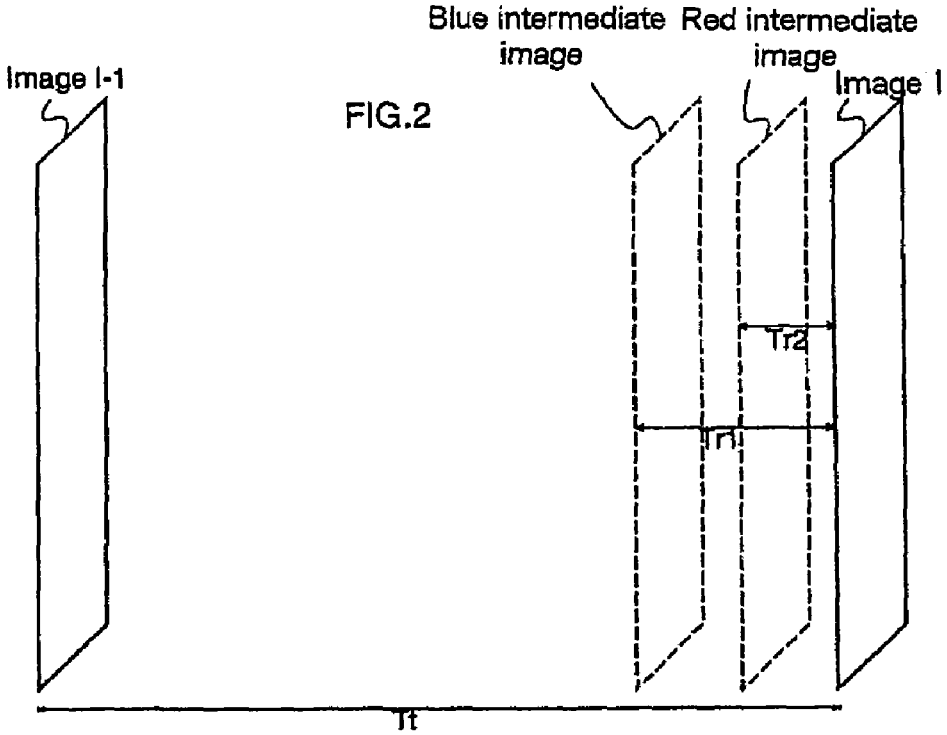
FIGS. 2 and 3 illustrate the intermediate image principle computed according to the invention.
Figure 3:
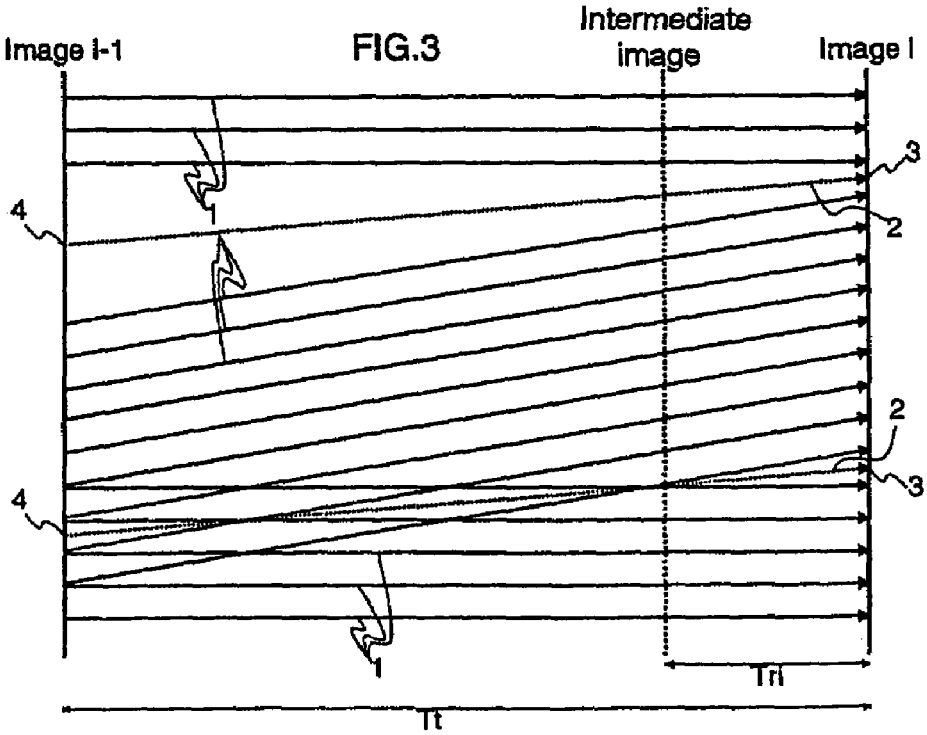
Figure 4:
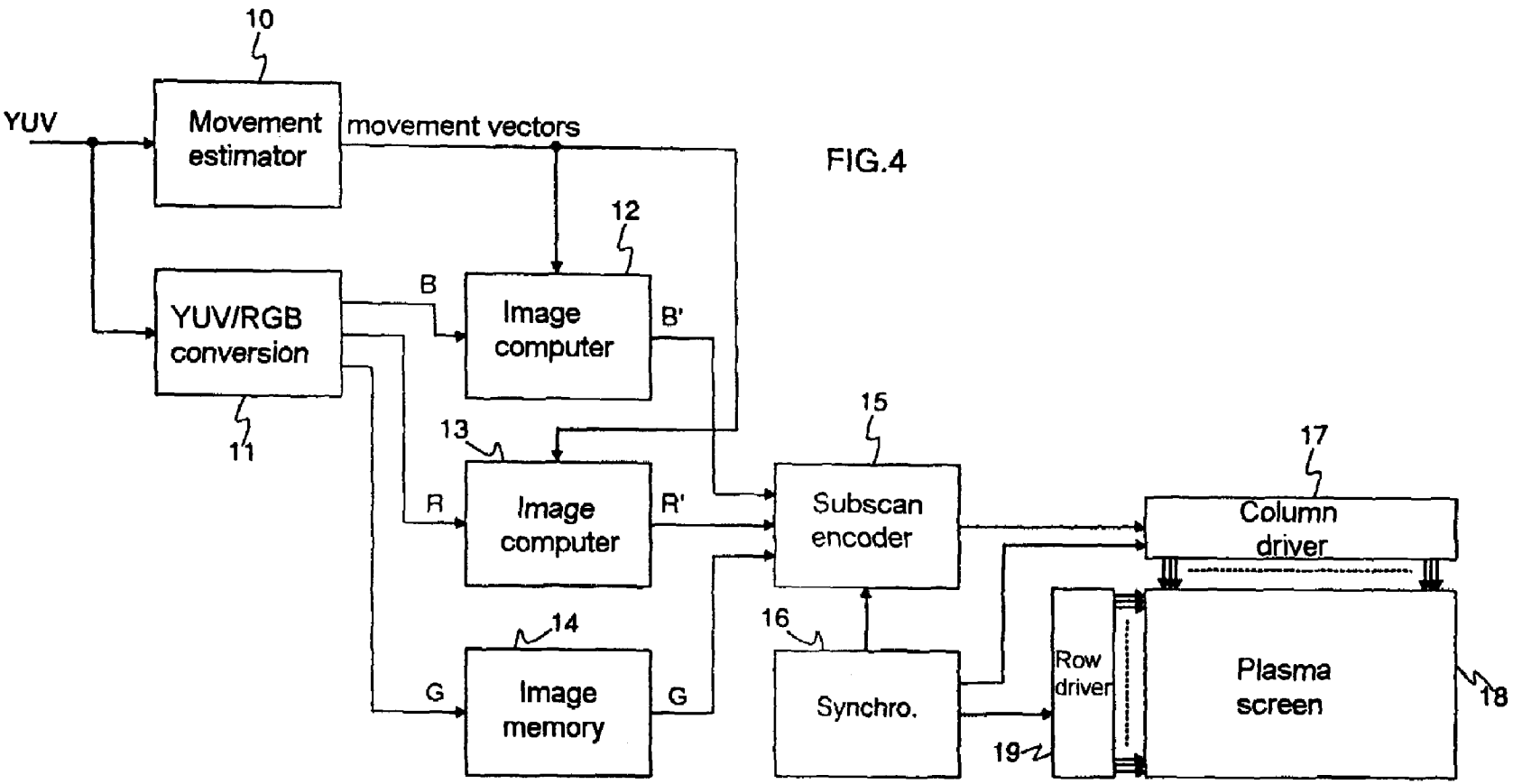
FIG. 4 illustrates a preferred embodiment of a phosphor display device according to the invention.
Figure 5:
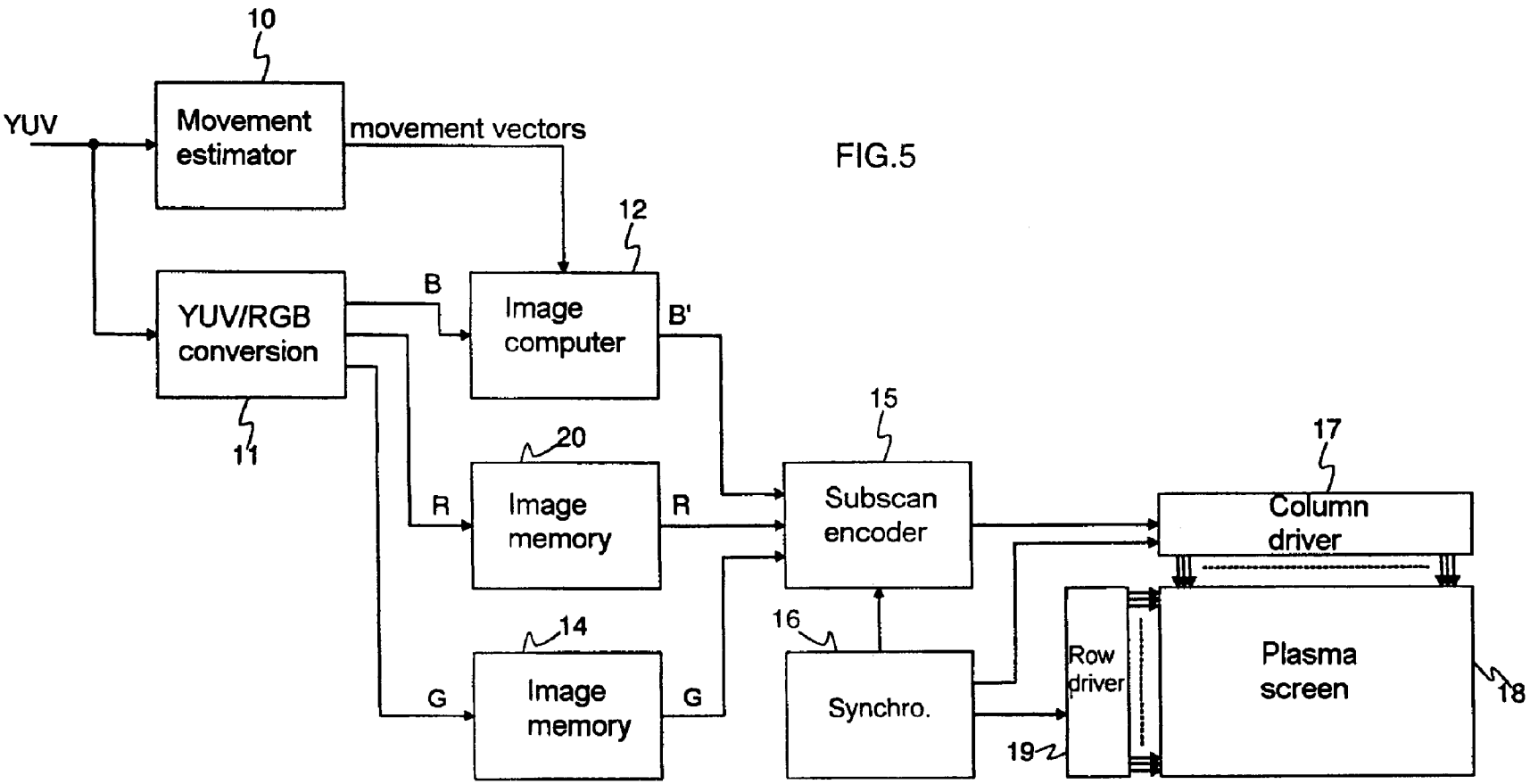
FIG. 5 illustrates a variant of the preferred embodiment of the invention.

The invention will be better understood, and other particular features and advantages will become apparent on reading the following description, the description refering to the appended drawings among which:

FIG. 1 shows phosphor response time diagrams,

FIGS. 2 and 3 illustrate the intermediate image principle computed according to the invention, FIG. 4 illustrates a preferred embodiment of a phosphor display device according to the invention, and FIG. 5 illustrates a variant of the preferred embodiment of the invention.

After having noted the disparities between the types of phosphor, it is appropriate first of all to study the conceivable solutions. It is apparent that in order to reduce the fault as much as possible, it is preferable to offset the light emission for the three types of phosphor. Unfortunately, other hardware constraints do not allow disassociation of the switching on corresponding to each type of phosphor. For a CRT, the three electron beams corresponding to each of the colours are simultaneously controlled. With regard to PDPs, the cells are addressed row by row and each row has three types of phosphor.

According to the invention, the information to be displayed is offset. As was seen previously, the blue phosphors have a much shorter persistence time than the red or green phosphors, and the red phosphors have a shorter persistence time than the green phosphors. Intermediate images will therefore be displayed instead of a current image, denoted image I in FIG. 2, on the blue and on the red. Thus while displaying the image I, the visual information displayed corresponds to the image I for green and to two intermediate images for blue and red.

The intermediate image can be computed using various techniques. A person skilled in the art can refer to the publications relating to the image computations used to make a 50/60 Hz or 50/100 Hz image frequency change.

Preferably, it is desired that the intermediate image be as close as possible to the image which would have to be displayed at that instant, especially with regard to moving objects. To compute the best possible image, it is appropriate to compute the intermediate image with movement compensation.

The movement compensation is carried out according to a known technique. Movement vectors 1 are computed from images I and I-1 such that a vector 1 corresponds to each pixel (consisting of three colours), as shown in FIG. 3. The intermediate image is computed by determining the value of each pixel by associating therewith the weighted value of pixels 3 and 4 of images I and I-1 directed by an extrapolated vector 2 that passes through the pixel of the intermediate image to be computed. This is summarized by the formula:

$$\text{intermediate pixel}=((\text{pixel } 3)\times(Tt-Tri)+(\text{pixel } 4)\times Tri)/Tt,$$

where Tt is the time period separating two images and Tri the time period separating the current image from the intermediate image.

The extrapolated vector 2 is, for example, the mean vector corresponding to the closest vectors 1. When the extrapolated vector 2 points between several pixels of the image I, then the corresponding pixel of the intermediate image corresponds to the mean of the closest pixels.

Of course, many other image extrapolation techniques using movement compensation can be used.

So that the compensation is able to have a real effect, it is appropriate that the time Tri separating the image I from the intermediate image is large enough to provide a correction but not too large so as not to reverse the display fault. It appears to be quite difficult to accurately determine the ideal time Tri.

A simple computing method giving an effective result consists in computing the instant corresponding to the mean centre of gravity of light emission for each type of phosphor in its operational environment. The time Tri corresponds to the difference between the instant corresponding to the centre of gravity of the slowest phosphor and the instant corresponding to the centre of gravity of the phosphor associated with the intermediate image. By way of example, with abovementioned the phosphors, the values Tr1=4 ms and Tr2=0.5 ms can be taken.

The term "centre of gravity of light emission" should be understood as meaning the instant after the excitation of the phosphor which corresponds to the emission of half the light energy. The term "mean centre of gravity" should be understood as meaning the mean of the centres of gravity corresponding to various excitation conditions. In fact, the centre of gravity varies as a function of the time and intensity of excitation. The mean of the centres of gravity can for example be found from extreme cases of operational conditions.

FIG. 4 shows an exemplary embodiment of a plasma display panel implementing the invention.

In the example shown, the PDP receives a signal of YUV type (luminance+2 chrominance components), for example extracted from a composite video signal. A movement estimator 10 receives the YUV signal and provides movement vectors computed from the signal received and from a previously stored image. A format conversion circuit 11 converts the YUV signal into three image signals of R, G and B type respectively correspondingly to the red, green and blue images to be superimposed in order to obtain a colour image. Three distinct image signals are shown, but in practice, it is also possible to use a parallel or serial bus in order to route these three image signals.

A first image computation circuit 12 receives, on the one hand, the blue image signal and, on the other hand, the movement vectors. The first image computation circuit 12 operates, for example, as indicated above or according to another image computation algorithm with movement compensation. The signal B' delivered by the computation circuit corresponds to the intermediate image in advance of the time Tr1 with respect to the current image for blue.

A second image computation circuit 13 receives, on the one hand, the red image signal and, on the other hand, the movement vectors. The second image computation circuit 13 is of the same type as the first image computation circuit 12 but using the time period Tr2 for the intermediate image. The signal R' provided by the computation circuit corresponds to the intermediate image for red.

An image memory 14 receives the green image signal in order to store it while computing the intermediate images. The memory 14 and the computation circuits 12 and 13 may, in practise, be connected to a bus in order to receive the R, G and B signals or to deliver the R×, G and B' signals.

A subscan encoding circuit 15 receives the G signal coming from the image memory 14, the B' and R' signals coming from the image computation circuits 12 and 13 and a synchronization signal coming from a synchronization circuit 16. The encoding circuit 15 delivers series of control bits to a column driver 17 in order to carry out column addressing of the plasma screen 18 (also called tile of the plasma panel). A row driver 19 allows selection by row or by group of rows. The synchronization circuit 16 sends the synchronization signals to the encoding circuit 15, the column driver 17 and the row driver 19 in order to ensure correct addressing of the screen 18. A person skilled in the art may refer to various documents of the prior art in order to produce circuits and drivers 15 to 19.

The embodiment may support many variants. By way of example, FIG. 5 shows a simplified variant. A person skilled in the art may notice that, in the example chosen, the disparities of operation between the green and red phosphors are not perceptible by the human eye. In this particular case, the correction made to the red does not bring any visible effect. It is then possible to replace the second computation circuit 13 with an image memory 20. This makes it possible to have a circuit which is less complex and therefore less expensive. However, such a simplification cannot be envisaged if the disparities of operation between all the phosphors are large.

It is also possible to use a circuit assembly using a microprocessor and a single memory in order to carry out the format conversion, the intermediate image computation and the storing of unmodified images. The architecture shown will then be produced by programming.

As indicated above, the invention may also be used for a CRT device. In this case, the three guns of the CRT receive the R', G and B' signals via shaping circuits.

In the embodiment presented, the intermediate image(s) is (are) located between the current image and the previous image. It is also possible to place the intermediate image between the current image and the following image. In this case, the current image corresponds to the fastest phosphors and the most advanced intermediate image corresponds to the slowest phosphors. However, such a variant requires delaying the image stream of an image to be displayed, which means having larger image memories.

Provision may be made for further adaptations according to the different variations mentioned throughout the description.

The invention claimed is:

1. Method for displaying a sequence of video images on a phosphor device comprising at least two types of phosphors (blue, green, red), characterized in that at least one intermediate image between two successive images (image I, image I-1) is computed, then one of the two successive images (Image I) is displayed on at least one type of phosphor (green) and the intermediate image is displayed simultaneously on at least one other type of phosphor (blue, red).

2. Method according to claim 1, characterized in that the intermediate image is computed with movement compensation.

3. Method according to either of claims 1 and 2, characterized in that the two successive images are a current image and a previous image, and in that the intermediate image corresponds to an image delayed from the current image by a defined time period (Tr1, Tr2) as a function of the types of phosphor.

4. Method according to claim 3, characterized in that the defined time period (Tr1, Tr2) is computed by taking the difference between the instants corresponding to the mean centres of gravity of light emission of the at least two types of phosphor.

5. Method according to one of claims 1 to 4, characterized in that three types of phosphor are used, and in that an intermediate image is displayed on at least one type of phosphor.

6. Device for displaying a video sequence comprising at least two types of phosphor, characterized in that it comprises means (12, 13) for computing at least one intermediate image placed between two successive images and means (14 to 19) for displaying the intermediate image on one of the types of phosphor and one of the successive images on the other type of phosphor.

7. Device according to claim 6, characterized in that it comprises a movement estimator (10) in order to be able to extrapolate movement to the intermediate Image.

8. Device according to either of claims 6 and 7, characterized in that it comprises three types of phosphors, and in that an intermediate image is displayed on at least one type of phosphor.

9. Device according to claim 8, characterized in that the computing means (12 or 13) compute the intermediate image only on the colour component which corresponds to the type of phosphor used to display the intermediate image.

10. Device according to one of claims 6 to 9, characterized in that the device is a plasma display panel.

* * * * *